US011236750B2

(12) United States Patent
Agostini

(10) Patent No.: US 11,236,750 B2
(45) Date of Patent: Feb. 1, 2022

(54) PUMP WITH A WEAR RING

(71) Applicant: XYLEM EUROPE GMBH, Schaffhausen (CH)

(72) Inventor: Mauro Agostini, Padua (IT)

(73) Assignee: XYLEM EUROPE GMBH, Schaffhausen (CH)

( * ) Notice: Subject to any disclaimer, the term of this patent is extended or adjusted under 35 U.S.C. 154(b) by 28 days.

(21) Appl. No.: 16/647,588

(22) PCT Filed: Sep. 25, 2018

(86) PCT No.: PCT/EP2018/075975
§ 371 (c)(1),
(2) Date: Mar. 16, 2020

(87) PCT Pub. No.: WO2019/063552
PCT Pub. Date: Apr. 4, 2019

(65) Prior Publication Data

US 2020/0232467 A1 Jul. 23, 2020

(30) Foreign Application Priority Data

Sep. 26, 2017 (EP) ..... 17193189

(51) Int. Cl.
*F04D 1/06* (2006.01)
*F04D 29/16* (2006.01)

(52) U.S. Cl.
CPC ..... *F04D 1/063* (2013.01); *F04D 29/167* (2013.01)

(58) Field of Classification Search
CPC ... F04D 1/063; F04D 1/06; F04D 1/08; F04D 17/08–18; F04D 29/002; F04D 29/007; F04D 29/08–167; F04D 29/40–445; F04D 29/448
See application file for complete search history.

(56) References Cited

U.S. PATENT DOCUMENTS 2,644,403 A * 7/1953 Dawson ..... F04D 7/045 415/121.1
5,295,786 A * 3/1994 Kajiwara ..... F04D 29/167 415/172.1

(Continued)

FOREIGN PATENT DOCUMENTS

CN 104903588 A 9/2015
DE 19916370 * 4/1999
DE 19916370 A1 10/2000

(Continued)

OTHER PUBLICATIONS

EP Search Report dated Mar. 22, 2018 re: Application No. EP 17 19 3189, pp. 1-2 citing: EP 0 257 358 A2, DE 199 16 370 A1, GB 1 110 660 A and US 2006/0269404 A1.

(Continued)

*Primary Examiner* — Bryan M Lettman
(74) *Attorney, Agent, or Firm* — Cantor Colburn LLP

(57) ABSTRACT

A pump with a wear ring includes at least one impeller; at least one diffuser; and at least one wear ring positioned between the at least one impeller and the at least one diffuser. The wear ring is removably coupled to the diffuser and includes radially extending clutch members. The clutch members are configured to hold a portion of the at least one diffuser.

11 Claims, 8 Drawing Sheets

(56) References Cited

U.S. PATENT DOCUMENTS

| | | | |
|---|---|---|---|
| 2006/0269404 | A1 | 11/2006 | Volk |
| 2007/0280823 | A1 | 12/2007 | Kanemori |

FOREIGN PATENT DOCUMENTS

| | | | | |
|---|---|---|---|---|
| EP | 0257358 | | * | 1/1987 |
| EP | 0257358 | A2 | | 3/1988 |
| EP | 3181909 | | * | 12/2015 |
| EP | 3181909 | A1 | | 6/2017 |
| GB | 1110660 | A | | 4/1968 |
| JP | S60178998 | A | | 9/1985 |
| JP | H07224783 | A | | 8/1995 |
| RU | 2213271 | C2 | | 9/2003 |

OTHER PUBLICATIONS

International Search Report dated Dec. 10, 2018 re: Application No. PCT/EP2018/075975, pp. 1-4, citing: EP 0 257 358 A2, DE 199 16 370 A1, GB 1 110 660 A and US 2006/0269404 A1.

Written Opinion dated Dec. 10, 2018 re: Application No. PCT/EP2018/075975, pp. 1-5, citing: EP 0 257 358 A2, DE 199 16 370 A1, GB 1 110 660 A and US 2006/0269404 A1.

* cited by examiner

PUMP WITH A WEAR RING

TECHNICAL FIELD

This disclosure relates generally to the field of centrifugal pumps and particularly to multistage centrifugal pumps.

BACKGROUND

A hydraulic pump is a mechanical source of power that converts mechanical power into flow pressure. The hydraulic pump can be driven by an electrical drive motor. A flow is generated with sufficient power to overcome pressure induced by the load at the hydraulic pump outlet. In operation, the hydraulic pump creates a vacuum at the inlet thereby forcing liquid from the reservoir into the inlet line by mechanical action and delivers the liquid to the outlet and into the hydraulic system.

Centrifugal pumps are used for a wide variety of liquid pumping applications. Centrifugal pumps, generally, have a impeller to pump liquid by centrifugal force. Centrifugal pumps may be constructed in single stage or multi-stage configurations. Each stage includes a stationary diffuser and a mating, rotating impeller driven by a pump shaft connected to a drive motor. The stages are arranged in "series" to provide an enhanced overall pressure capability.

Wear rings may be used to absorb thrust, help prevent wear and/or provide a seal-like construction between different parts of the pump. Conventional wearing rings may be formed of metal, ceramic, plastic or carbon materials. The wear rings become consumed during operation and replacement of worn wear rings is required for normal operations.

In a centrifugal pump, a wear ring may be disposed between the impeller and a diffuser. The wear ring may be contained in a substrate that is coupled to the main body of the diffuser or the pump housing. Generally, a wear ring may be contained in a support structure that is nested or welded to a support surface on the pump housing or the body of the diffuser. Accordingly, in order to replace a worn wear ring, the support structure is first detached from the support surface and the wear ring therein replaced subsequently.

The present disclosure is directed, at least in part, to improving or overcoming one or more aspects of the prior art system.

BRIEF SUMMARY OF THE INVENTION

The present disclosure describes a pump comprising at least one impeller; at least one diffuser; and at least one wear ring positioned between the at least one impeller and the at least one diffuser and removably coupled to the diffuser, the at least one wear ring having a plurality of radially extending clutch members wherein the clutch members are configured to hold a portion of the at least one diffuser.

BRIEF DESCRIPTION OF THE DRAWINGS

The foregoing and other features and advantages of the present disclosure will be more fully understood from the following description of various embodiments, when read together with the accompanying drawings, in which.

DETAILED DESCRIPTION

Figure 1:
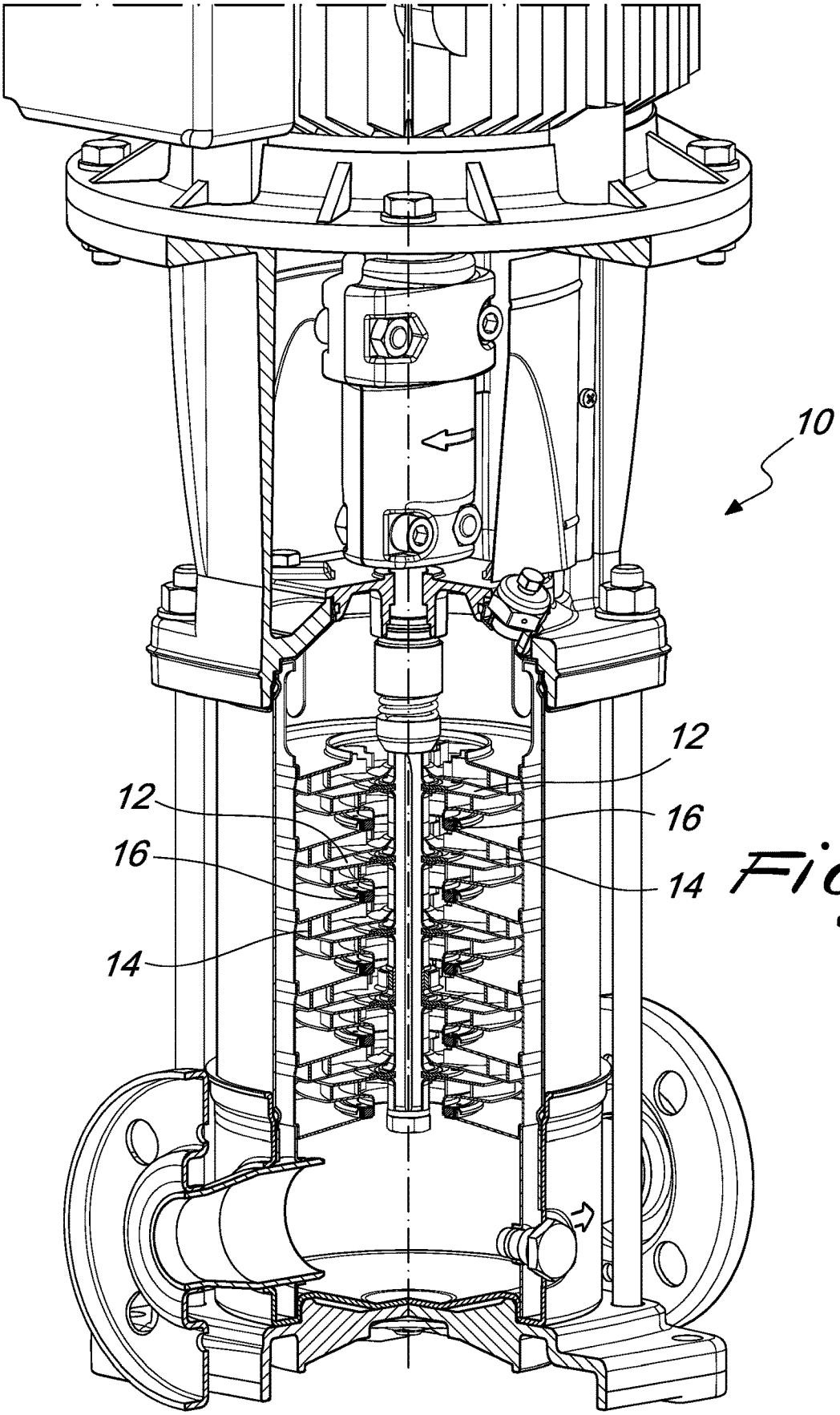
FIG. 1 is a partially sectioned view a pump according to the present disclosure.
Figure 2:
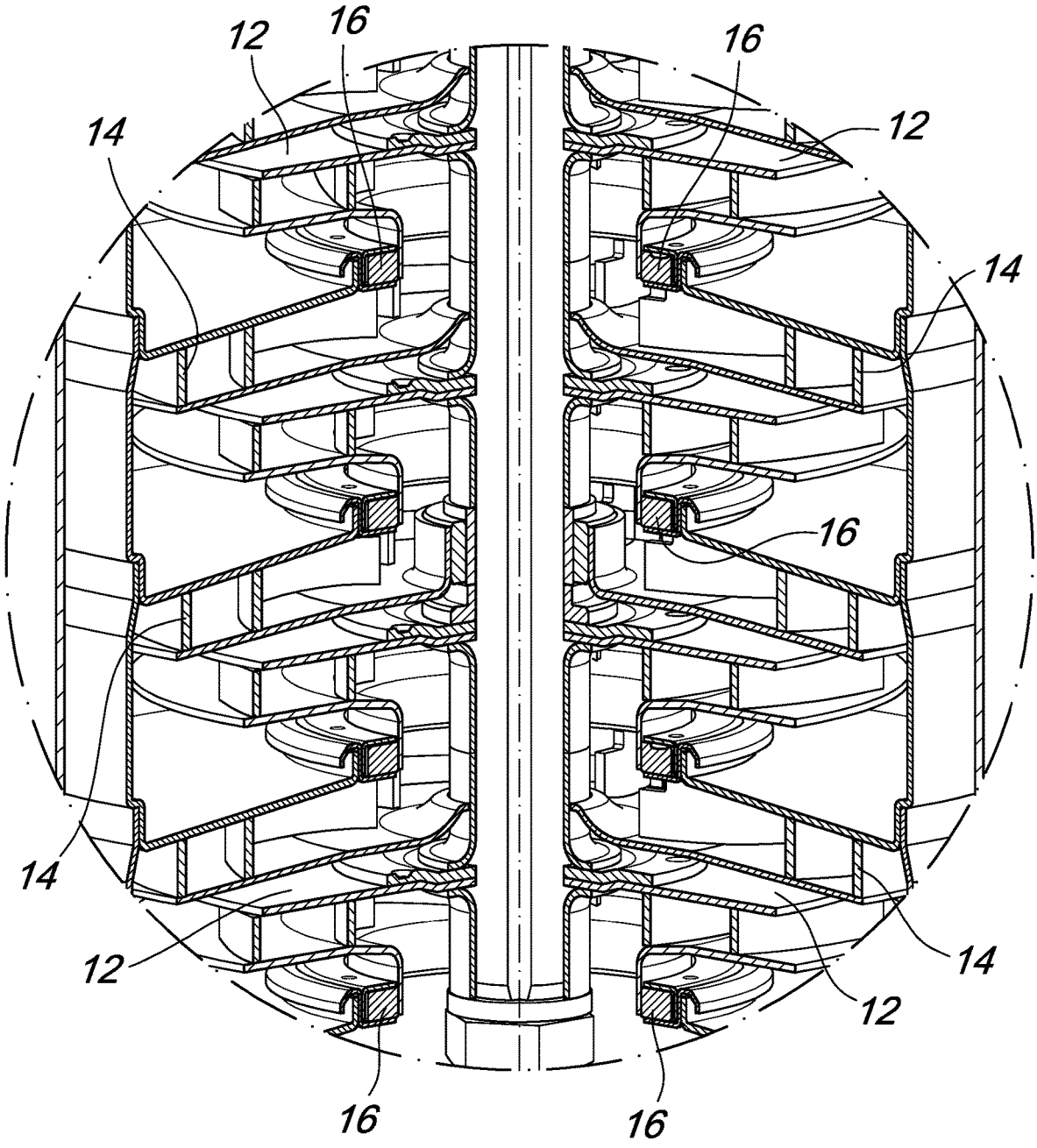
FIG. 2 is an enlarged view of a portion of the pump of FIG. 1.

This disclosure generally relates to a pump having a wear ring removably coupled to a diffuser. FIG. 1 illustrates a pump 10. FIG. 2 illustrates a enlarged view of a portion of the pump 10. The pump 10 comprises at least one impeller 12, at least one diffuser 14 and at least one wear ring 16.

Figure 3:
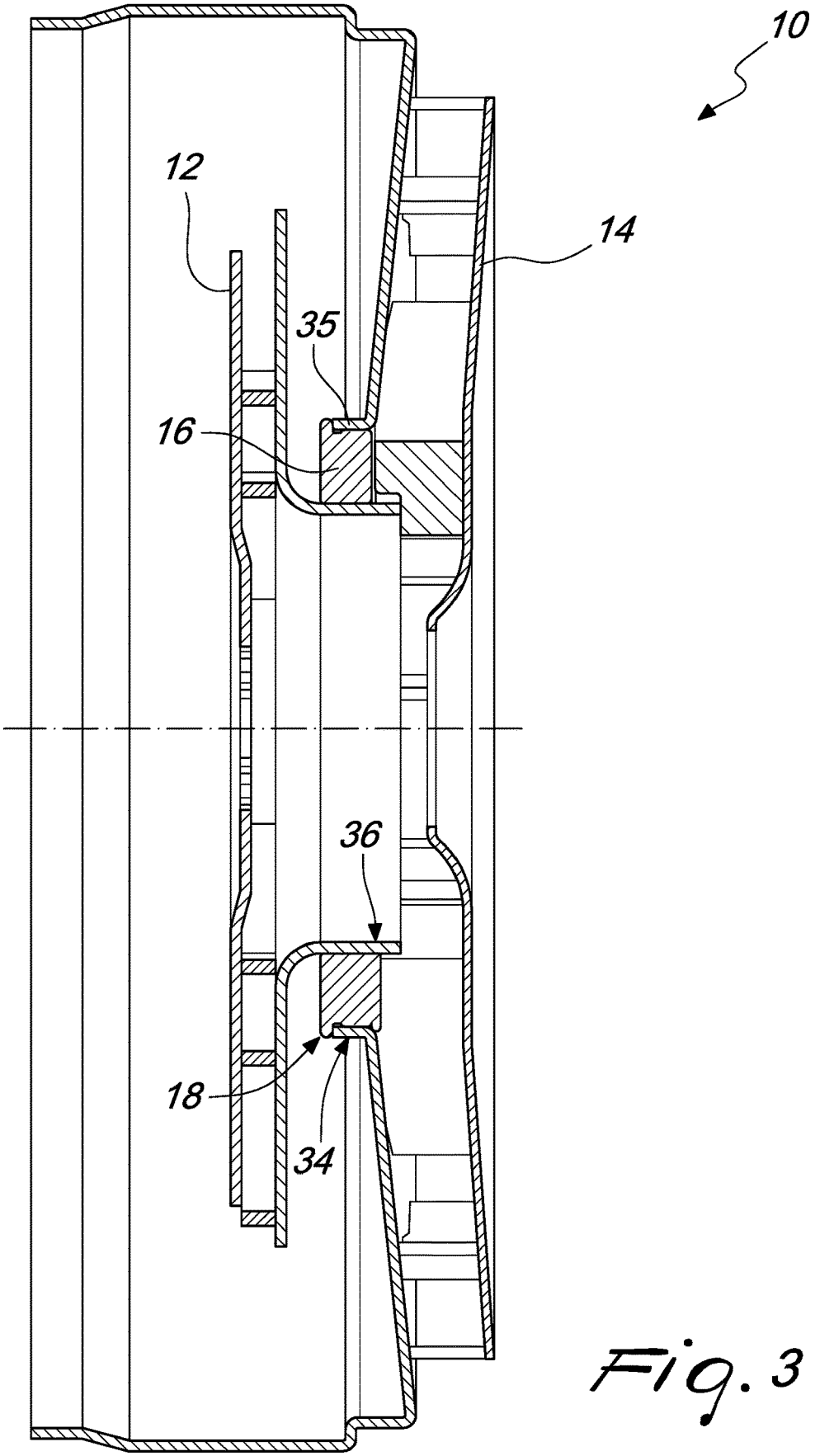
FIG. 3 is a cross-sectional view of a portion of the pump of FIG. 1.
Figure 4:
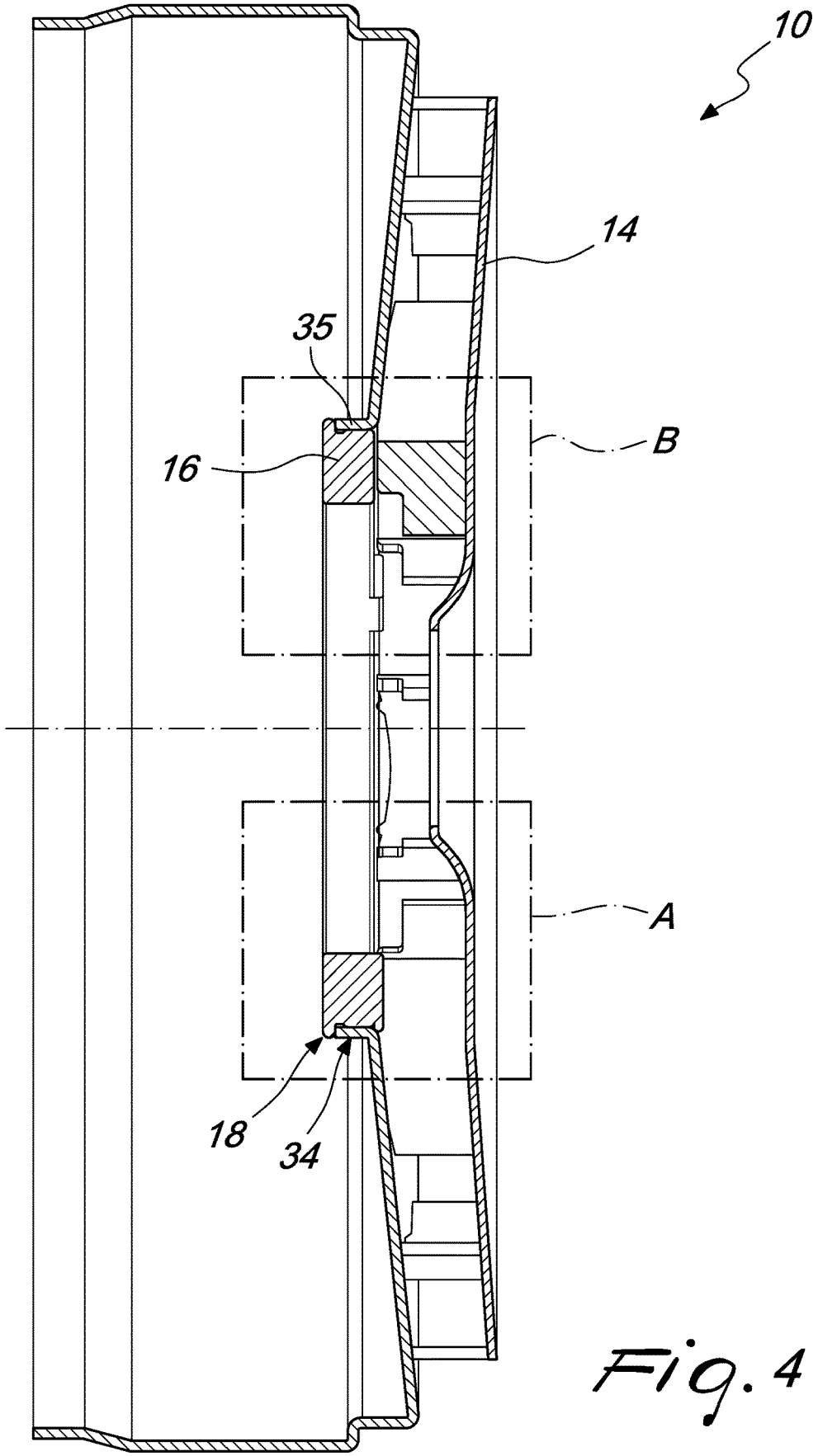
FIG. 4 is the cross-sectional view of a portion of the pump of FIG. 3 excluding the impeller.

FIGS. 3 and 4 illustrate a section through the pump 10. With reference to FIGS. 3 and 4, The wear ring 16 is disposed between the impeller 12 and the diffuser 14. Wear ring 16 is disposed at the inlet 34 of the diffuser 14. Wear ring 16 is disposed at the neck 35 of the inlet 34. Wear ring 16 is positioned adjacent the eye 36 of the impeller 12.

Wear ring 16 is removably coupled to the diffuser 14. Wear ring 16 is removably coupled to the inlet 34 of the diffuser 14. Wear ring 16 is removably coupled to the inner surface of the inlet 34. The impeller 12 may be in contact with the wear ring 16 during operation of the pump 10. The outer surface of the eye 36 of the impeller 12 may be in slidable contact with the wear ring 16 during operation.

Wear ring 16 is made of a deformable material. Wear ring 16 is configured to undergo a deformation during mounting to the diffuser 14 and removal from therefrom. In an embodiment, wear ring 16 is made of a plastic material.

The wear ring 16 has a plurality of radially extending clutch members 18. The clutch members 18 are configured to hold a portion of the at least one diffuser 14. Clutch members 18 are configured to hold a portion of the inlet 34 of the diffuser 14. Clutch members 18 are configured to engage at the inner surface of the neck 35 of the inlet 34. Clutch members 18 are configured to engage opposite ends of the inlet 34.

Figure 5:
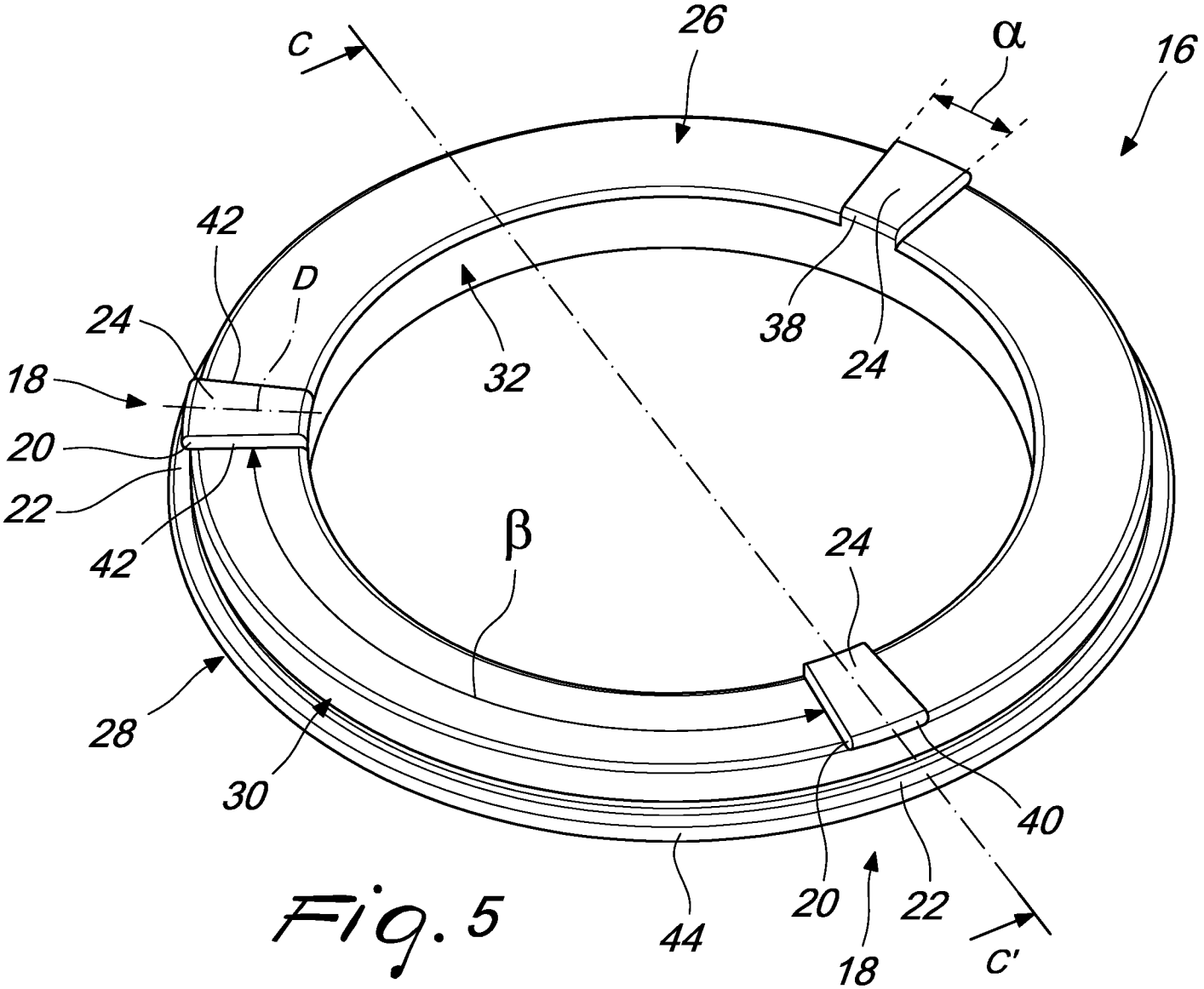
FIG. 5 is an isometric view a wear ring disposed in the pump of FIG. 1.
Figure 6:
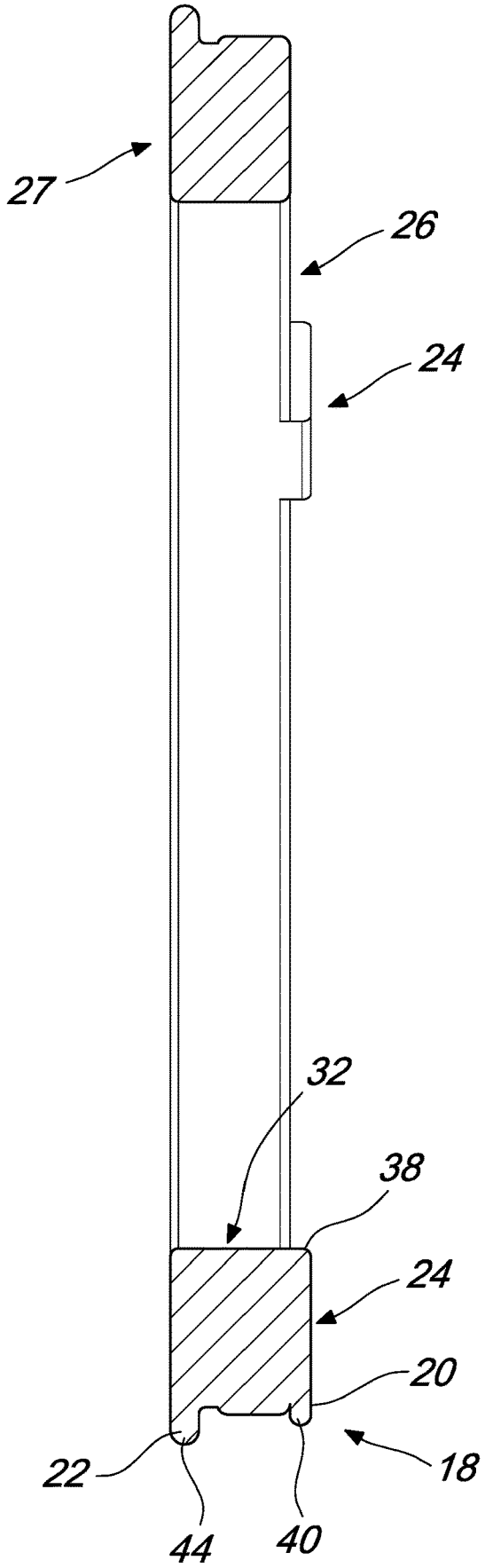
FIG. 6 is a cross-sectional view through the wear ring along line C-C' of FIG. 5.

FIG. 5 illustrates the wear ring 16 and FIG. 6 illustrates a section through the wear ring 16. With reference to FIGS. 2 and 3, the wear ring 16 is substantially annular. Wear ring 16 has an outer surface 30 and an inner surface 32. The outer surface 30 may contact the diffuser 14. Inner surface 32 may contacts the impeller 12. Clutch members 18 extend radially away from the outer surface 30. Wear ring 16 has a first side 26 and an opposite second side 27. First and second side 26, 27 extend between the outer surface 30 and the inner surface 32.

Each clutch member 18 comprises a first and a second tab portions 20, 22. The first and second tab portions 20, 22 are spaced apart. First and second tab portions 20, 22 are spaced apart on the outer surface 30. First and second tab portions 20, 22 are disposed on opposite edges of the outer surface 30. Second tab portions 22 extends further from the outer surface 30 than the first tab portions 20. First and second tab portions 20, 22 are configured so as to engage opposite ends of the inlet 34 of the diffuser 14.

With reference to FIG. 5, the first and second tab portions 20, 22 may be vertical relative to the outer surface 30. The first and second tab portions 20, 22 may be substantially perpendicular relative to the outer surface 30. Each clutch member 18 may have a substantially U-shaped cross-section formed by the first and second tab portions 20, 22 bordering the outer surface 30.

With reference to FIGS. 5 and 6, the first tab portion 20 is an extension of a tab 24. The tab 24 is provided on the first side 26 of the wear ring 16. Tab 24 may be formed as a raised platform on the first side 26. Tab 24 raises substantially vertically from the first side 26. Tab 24 extends across the first side 26. Tab 24 has a longitudinal axis D that extends across the first side 26.

Tab 26 has an inner end 38 opposite to the first tab portion 20. Inner end 38 does not extend over the inner surface 32. Inner end 38 is in line with the inner surface 32. Tab 24 extends over the inner surface 32 through the first tab portion 20. First tab portion 20 has a free tab end 40 that is curved across a direction transverse to the longitudinal axis D of the tab 26. Curved free tab end 40 reduces resistance against the inner surface of the inlet 34 of the diffuser 14 during mounting and removal of the wear ring 16.

Tab 24 has tab sides 42. The tab sides 42 may be perpendicular to the first side 26. Tab sides 42 diverge from the inner end 38 to the first tab portion 20. Tab sides 42 diverge from the inner surface 32 to the outer surface 30 of the wear ring 16. The tab sides 42 have an angle $\alpha$ that is configured as required. In an embodiment, the tab sides 42 have an angle $\alpha$ of 10 degrees.

The wear ring 16 may comprise a number of tabs 24 as required. In an embodiment, the wear ring 16 may comprises at least two tabs 24. The longitudinal axes D of the two tabs 24 extend radially relative to the wear ring 16. Tabs 24 are mutually angularly spaced on the first side 26. The tabs 24 are mutually angularly spaced at an angle $\beta$ that is configured as required. The tabs 24 are mutually angularly spaced at an angle $\beta$ of 180 degrees.

In a further embodiment, the wear ring 16 may comprise three tabs 24. The longitudinal axes D of the three tabs 24 extend radially relative to the wear ring 16. Tabs 24 are mutually angularly spaced on the first side 26. The tabs 24 are mutually angularly spaced at an angle $\beta$ that is configured as required. The tabs 24 are mutually angularly spaced at an angle $\beta$ of 120 degrees.

The second tab portion 22 is portion of a lip 28. Lip 28 extends laterally from the outer surface 30 of the at least one wear ring 16. The lip 28 extends around the wear ring 16. Lip 28 is configured as a continuous ring around the outer surface 30. Lip 28 has a free lip end 44 that is curved across a direction transverse to the extension of the lip 28. Curved free lip end 44 reduces resistance against the inner surface of the inlet 34 of the diffuser 14 during mounting and removal of the wear ring 16.

In an embodiment, the second tab portion 22 is a discrete structure extending from the outer surface 30. Second tab portion 22 extends laterally from the outer surface 30 of the at least one wear ring 16. Second tab portion 22 has an end joined to the outer surface and a free lip end 44. Free lip end 44 is curved across a direction transverse to the longitudinal axis of the second tab portion 22. Curved free lip end 44 reduces resistance inner surface of the inlet 34 of the diffuser 14 during mounting and removal of the wear ring 16.

The wear ring 16 may comprise the same number of second tab portions 22 as tabs 24. The longitudinal axes of the second tab portions 22 extend radially relative to the wear ring 16. Second tab portions 22 are mutually angularly spaced on the first side 26.

Figure 7:
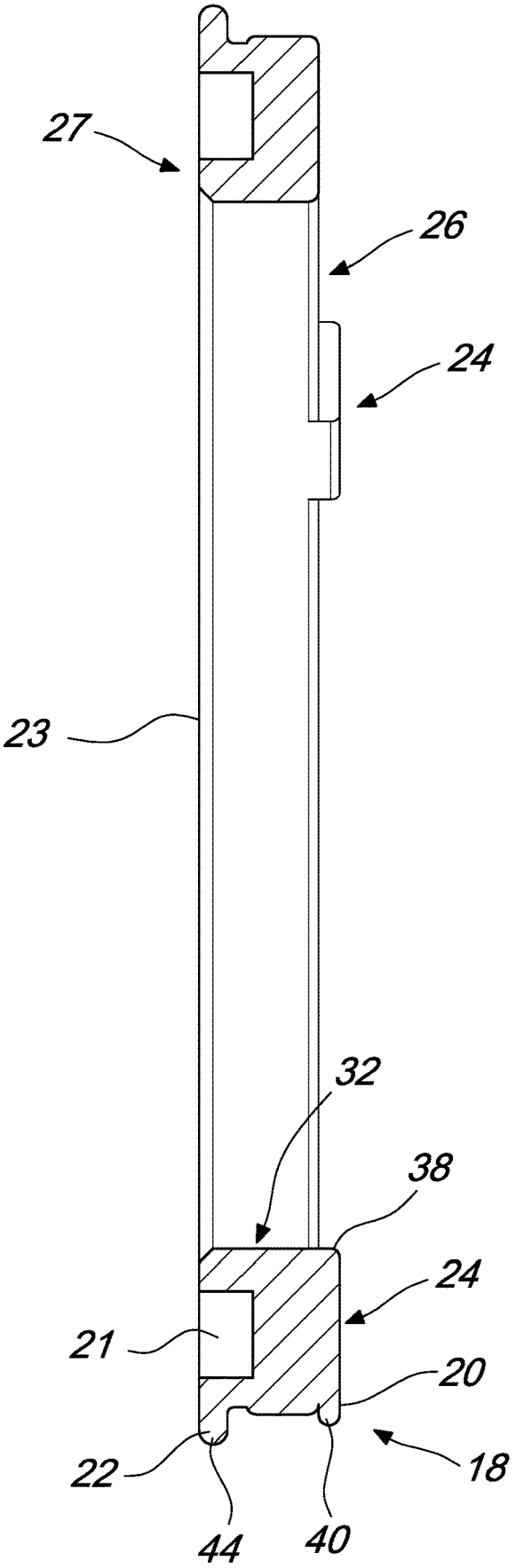
FIG. 7 is a cross-sectional view through a further embodiment of the wear ring along line C-C' of FIG. 5.

With reference to FIG. 7, in an embodiment, the wear ring 16 may have a cut-out 21. The cut-out 21 may be annular. Cut-out 21 may be positioned between outer surface 30 and an inner surface 32. Cut-out 21 may have an opening on the second side 27. Cut-out 21 may reduce the weight of the wear ring 16.

Wear ring 16 may have an inclined surface 23 extending between the second side 27 and the inner surface 32. Inclined surface 23 may be annular. Inclined surface 23 may concentric with the inner surface 32. Inclined surface 23 may prevent the wear ring 16 from adhering to the eye 36 of the impeller 12.

Figure 8:
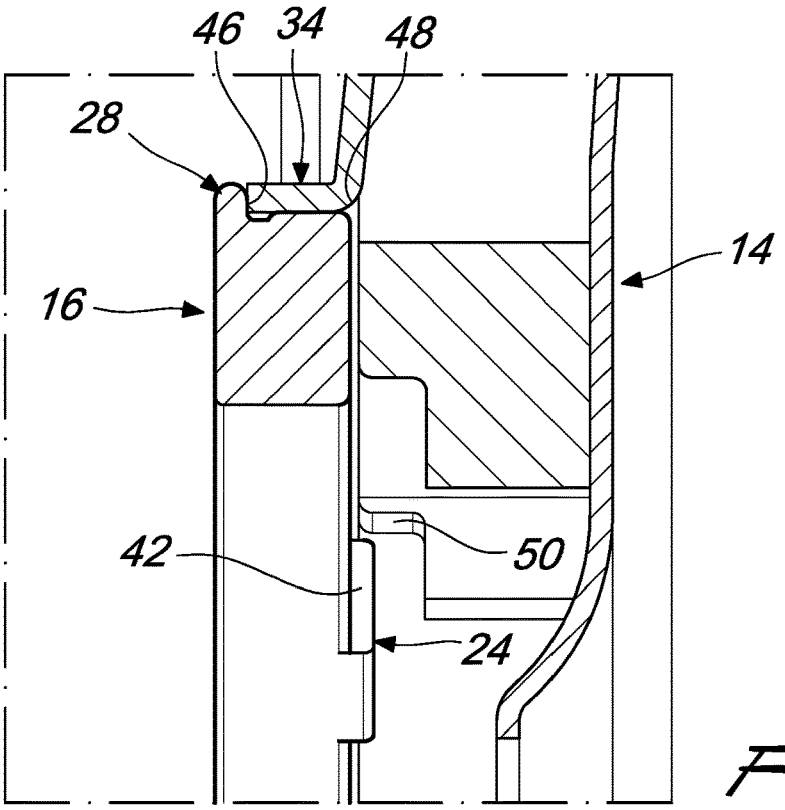
FIG. 8 is an enlarged view of part A of the pump of FIG. 4.

With reference to FIG. 8, the wear ring 16 is mounted to the diffuser 14 and the clutch member 18 is coupled to the inlet 34 of the diffuser 14. Wear ring 16 is retained in the mounted position by the plurality of clutch members 18 engaging opposite ends of the inlet 34. In an embodiment, the wear ring 16 is floatingly mounted to the inlet 34. The plurality of clutch members 18 may loosely hold the inlet 34. The plurality of clutch members 18 engage opposite ends of the inlet 34 with slack to provide for minimal relative movement. The wear ring 16 may be capable of angular movement relative to the inlet 34. The first tab portion 20 enages a shoulder 48 joined to the neck 35. Shoulder 48 defines the aperture of the inlet 34 into the diffuser 14. The plurality of first tab portions 20 is mutually angularly spaced on the shoulder 48 around the aperture of the inlet 34.

The second tab portion 22 engages a rim 46 of the inlet 34. Rim 46 defines the aperture of the inlet 34 to the exterior of the diffuser 14. In an embodiment, the lip 28 engages the rim 46. Clutch member 18 is coupled over the inlet 34 such that the outer surface 30 of the wear ring 16 may contacts the inner surface of the neck 35.

The first tab portion 20 extends from the tab 24. The tab 24 extends axially from the wear ring 16. The tab 24 extends axially from the wear ring 16 beyond the shoulder 48. At least one tab 24 is configured to abut a vane 50 of the diffuser 14. The at least one tab 24 abuts a vane 50 when the wear ring 16 undergoes a rotational movement on the inlet 34. The abutting engagement of the tab 24 and the vane 50 serves as an anti-rotation mechanism of the mounted wear ring 16.

In an embodiment, a terminal diffuser 14 does not have a vane 50. The tab 24 may be configured to abut a body (not shown) extending from the diffuser 14. The body may be soldered to the terminal end of the diffuser 14 and extends from the diffuser.

Figure 9:
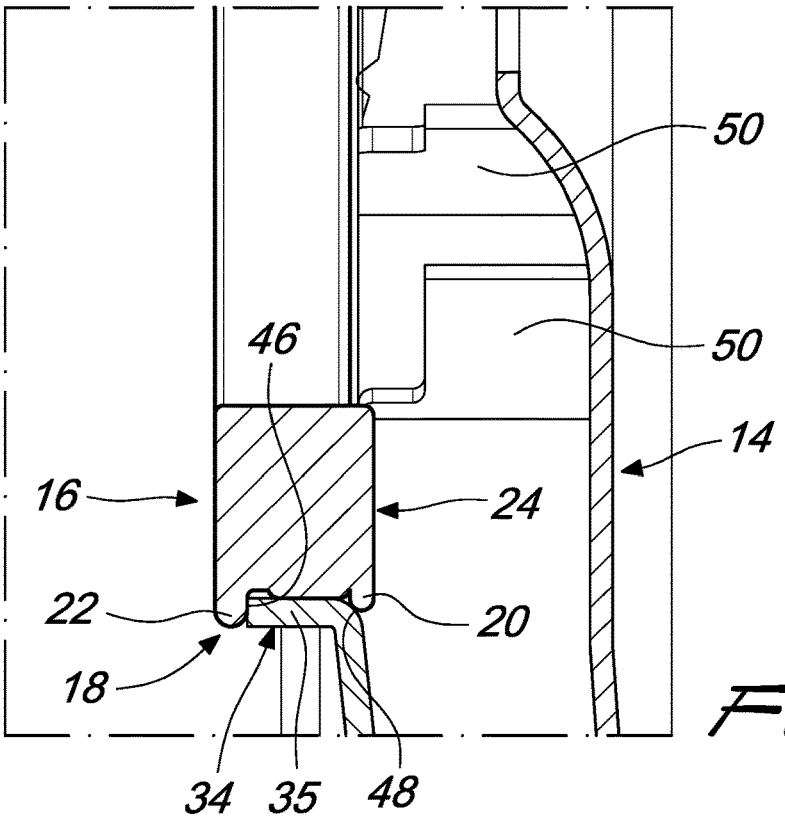
FIG. 9 is an enlarged view of part B of the pump of FIG. 4.

FIG. 9 illustrates a portion of the mounted wear ring 16 not having the clutch member 18. The outer surface 30 of the wear ring 16 is held against the inner surface of the inlet 34. In an embodiment, the lip 28 engages the rim 46. The side 42 of the tab 24 is available to abut the vane 50 of the diffuser 14.

In an embodiment, the pump 10 is a multi-stage pump comprising a plurality of impellers 12; a plurality of diffusers 14 and a plurality of wear rings 16.

The skilled person would appreciate that foregoing embodiments may be modified or combined to obtain the pump 10 of the present disclosure.

INDUSTRIAL APPLICABILITY

This disclosure describes a pump 10 having the wear ring 16 that is coupled to the diffuser 14. The wear ring 16 is removably coupled to the diffuser 14. A worn wear ring 16 is removed with efficiency and ease. The clutch members 18 enables the efficient removal and mounting of the wear ring 16. Further, in a multistage pump 10 having a plurality of impellers 12 and diffusers 14, the removably coupled wear rings 16 results in cost savings.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein.

Where technical features mentioned in any claim are followed by reference signs, the reference signs have been included for the sole purpose of increasing the intelligibility of the claims and accordingly, neither the reference signs nor their absence have any limiting effect on the technical features as described above or on the scope of any claim elements.

One skilled in the art will realise the disclosure may be embodied in other specific forms without departing from the disclosure or essential characteristics thereof. The foregoing embodiments are therefore to be considered in all respects illustrative rather than limiting of the disclosure described herein. Scope of the invention is thus indicated by the appended claims, rather than the foregoing description, and all changes that come within the meaning and range of equivalence of the claims are therefore intended to be embraced therein.

The invention claimed is:

1. A pump comprising:

at least one impeller;

at least one diffuser having an inlet; and at least one wear ring positioned between the at least one impeller and the at least one diffuser and removably coupled to the diffuser, the at least one wear ring having a plurality of radially extending clutch members, wherein the clutch members are configured to hold a portion of the at least one diffuser, wherein said plurality of radially extending clutch members engage opposite ends of said inlet with slack to provide for minimal relative movement, said at least one wear ring being capable of angular movement relative to the inlet.

2. The pump of claim 1, wherein each clutch member of the plurality of radially extending clutch members comprises a first and a second tab portions wherein the first and second tab portions are spaced apart.

3. The pump of claim 2, wherein the first tab portion is an extension of a tab provided on a first side of the at least one wear ring, the first tab portion extending from the first side of the at least one wear ring.

4. The pump of claim 3, wherein the at least one wear ring has an inclined surface extending between a second side and an inner surface thereof, the inclined surface being annular and concentric with said inner surface.

5. The pump of claim 2, wherein the second tab portion is part of a lip extending laterally from an outer surface of the at least one wear ring.

6. The pump of claim 5, wherein the lip extends around the at least one wear ring.

7. The pump of claim 1, wherein the at least one wear ring comprises three tabs mutually angularly spaced on the first side.

8. The pump of claim 7, wherein the tabs are mutually angularly spaced at an angle ($\alpha$) of 120 degrees.

9. The pump of claim 1, wherein the at least one wear ring is composed of a deformable material.

10. The pump of claim 1, wherein the at least one impeller contacts the an inner surface of the at least one wear ring.

11. The pump of claim 1, wherein the pump is a multi-stage pump comprising a plurality of impellers, a plurality of diffusers, and a plurality of wear rings.

* * * * *